United States Patent [19]

Luecke

[11] Patent Number: 5,066,005

[45] Date of Patent: Nov. 19, 1991

[54] ENHANCED CORE MOVEMENT TRAINING BENCH

[76] Inventor: Thomas W. Luecke, 3785 Moorhead Ave., Boulder, Colo. 80303

[21] Appl. No.: 591,453

[22] Filed: Oct. 1, 1990

[51] Int. Cl.[5] ..... A63B 21/04

[52] U.S. Cl. ..... 272/136; 272/120; 272/127; 272/145

[58] Field of Search ..... 272/72, 120, 121, 127, 272/134, 135, 136, 138, 142, 144, 145

[56] References Cited

U.S. PATENT DOCUMENTS

| | | | |
|---|---|---|---|
| 1,750,549 | 3/1930 | Thomson et al. . | |
| 1,979,783 | 11/1934 | Williams et al. | 272/72 |
| 1,980,036 | 11/1934 | Casler et al. | 272/72 |
| 1,996,350 | 4/1935 | Schaff | 272/120 |
| 2,733,922 | 2/1956 | Diego | 272/120 |
| 3,261,606 | 7/1966 | Elia et al. | 272/72 |
| 3,586,322 | 6/1971 | Kverneland | 272/72 |
| 3,770,267 | 11/1973 | McCarthy . | |
| 4,272,074 | 6/1981 | Sferle | 272/120 |
| 4,383,684 | 5/1983 | Schliep | 272/145 |
| 4,398,713 | 8/1983 | Ellis | 272/145 |
| 4,700,945 | 10/1987 | Rader | 272/127 |
| 4,700,946 | 10/1987 | Breunig | 272/134 |
| 4,706,953 | 11/1987 | Graham | 272/120 |
| 4,884,802 | 12/1989 | Graham | 272/136 |
| 4,884,804 | 12/1989 | Fenwick | 272/145 |
| 4,911,438 | 3/1990 | Van Straaten | 272/138 |
| 4,915,378 | 4/1990 | Abrahamian et al. | 272/134 |

FOREIGN PATENT DOCUMENTS

| | | | |
|---|---|---|---|
| 8803825 | 6/1988 | Int'l Pat. Institute | 272/145 |

*Primary Examiner*—Robert Bahr

*Attorney, Agent, or Firm*—John R. Flanagan

[57] ABSTRACT

An enhanced core movement training bench includes an adjustable arm cord mounting assembly, an adjustable footbar assembly, and a jump board attachment. The arm cord mounting system includes a pair of elongated flexible arm cords each entrained over a lower fixed height pulley and an upper variable height pulley mounted for adjustable movement along a vertical slot in each upright corner post at one end of the bench frame, thereby permitting infinite adjustment of the vertical positions above the frame of the upper pulleys and the portions of the arms cords extending from the corner posts to the user. Adjustable anchoring devices attach the cords to the mobile carriage for infinitely adjusting the effective lengths of the cords. The adjustable footbar assembly includes a horizontal cylindrical footbar extending between and mounted at its opposite ends through vertical slots defined in a pair of vertical support members for permitting infinite adjustment of the vertical position of the footbar above the bench frame. The vertical support members are installed upright in a selected one pair of vertical channels arranged in a pair of fore-and aft rows of channels of a mounting structure for permitting horizontal adjustment of the vertical supports and footbar to any of a plurality of discrete fore-and-aft spaced, horizontal locations. The jump board attachment is adapted for temporary attachment upon and along the inboard side of the vertical support members of the adjustable footbar assembly.

19 Claims, 5 Drawing Sheets

ENHANCED CORE MOVEMENT TRAINING BENCH

BACKGROUND OF THE INVENTION

1. Field of the Invention

The present invention generally relates to human body training and, more particularly, is concerned with an enhanced bench for use in training the muscles of the center, or "core", of the body which primarily stabilize the body during normal moving, standing and sitting activities.

2. Description of the Prior Art

Total body training is directed to muscles of the center, or core, of the body. These muscles control the head, neck, ribs, spine and pelvis. They stabilize, or anchor, and also move the central pillar of the body, including the head-neck, spine-ribs, and spine-pelvis systems. Most of the activity of the core muscles is tonic (stabilizing) rather than phasic (moving), which means that the muscles are acting continually throughout the day as a person is moving, standing, or sitting.

Expressed another way, the "core" is a pathway through the center of one's body by which energy can flow freely through the interior muscles of the body to perform desired body activities. When a person performs from the "core", maximum power and control are exerted over body movement. Body movement also becomes more efficient.

A particular mode of core muscle training must be followed in order to receive the benefits of improved strength, control and insurance against injury. This mode is called core patterning which is a system of training that provides support for moving through the core in a consistent pattern. Conventional exercising typically involves passive stretching of sets of muscles substantially in isolation from one another and frequently beyond their natural ranges. The potential for injury is thereby increased. In contrast, core muscle training involves dynamic stretching of different muscle systems together such that the total body is supporting the movement and the natural range of muscle stretching is not exceeded. Power is thereby increased and the potential for injury is reduced.

Heretofore, a Pilates type bench was devised for use in core muscle movement training. The bench is named after an early practicioner and instructor of total body training. The traditional prior art pilates bench has a rectangular frame supporting a mobile carriage mounted for reciprocal movement on a pair of spaced tracks. A number of elongated stretchible elements, such as springs or cords, extend between and connect with the carriage and one end of the frame. Also, a footbar is rigidly mounted at the one end of the frame and a system of cords and pulleys are mounted at the opposite end of the frame and connected to the mobile platform at a side opposite from the stretchible elements.

A user lying backside down on a platform supported by the mobile carriage can undergo core muscle training by using his or her legs to push off from the footbar. The user can move the carriage and his or her body supported thereon against the tension of the stretchible elements simulating the force of gravity. A user sitting or standing on the platform of the mobile carriage can also strengthen other body movements. By using his or her arms to pull on the cords entrained over the pulleys mounted at the other end of the frame and connected to the mobile carriage, the user can move the carriage and his or her body supported thereon against the tension of the stretchible elements which again simulate the force of gravity.

This traditional prior art bench has been a useful device for practicing core muscle training. However, its construction, as described above, has several drawbacks which limit its utility and render it less than an optimum tool for practicing total body training. Consequently, a need exists for improvement of the traditional prior art Pilates bench in order to eliminate its drawbacks and further enhance its overall utility.

SUMMARY OF THE INVENTION

The present invention provides an enhanced core movement training bench designed to satisfy the aforementioned needs. The enhanced bench retains the basic design of the traditional prior art Pilates bench and, in addition thereto, incorporates several new and improved features which alleviate the shortcomings associated with the traditional prior art bench so as to accommodate users of a wide range of sizes. Although these features can be employed independently in separate core movement training benches, they may advantageously all be employed in the same bench and so all of the features are disclosed herein.

These improved features are an adjustable arm cord mounting assembly, an adjustable footbar assembly, and a jump board attachment. The traditional prior art bench has an arm cord mounting system supported at one end of the frame but at a fixed location inboard of and within the height profile of the frame of the bench. The prior art bench also has a footbar assembly supported adjacent the opposite end of the frame but at a fixed height and restricted solely from moving toward the opposite end of the frame.

The adjustable arm cord mounting system of the enhanced bench, the first feature of the present invention, includes a pair of arm cords each entrained around a lower fixed height guide and an upper variable height guide mounted for adjustable movement along a vertical slot in each of a pair of corner post extensions extending upright at the one end of the enhanced bench frame. These vertical mounting slots permit infinite adjustment of the vertical positions above the bench frame of the upper guides and the portions of the arms cords extending from the corner post extensions to the user. The adjustable arm cord mounting assembly also includes anchoring devices attaching the cords to the mobile carriage of the enhanced bench. These anchoring devices are operable for infinitely adjusting the effective lengths of the cords. These adjustment capabilities of the adjustable arm cord mounting assembly enable a user to quickly and easily select a suitable position on the platform of the mobile carriage and to tailor the bench to accommodate a range of motions corresponding to the user's particular body size. In such manner, a fixed setup location, as provided in the traditional prior art bench, is not permitted to dictate or influence the pattern of user movement.

The adjustable footbar assembly of the enhanced bench, the second feature of the present invention, includes a padded horizontal cylindrical footbar extending between and mounted at its opposite ends through vertical slots defined in a pair of vertical support members. The vertical slots permit infinite adjustment of the vertical position of the footbar above the enhanced bench frame. The support members are installed upright in a selected one pair of vertical channels defined in a pair of holders of a mounting structure of the adjustable footbar assembly. Each holder has a plurality of the vertical channels arranged in tandem relation to one another in a fore-and-aft extending row and located along the interior opposite sides of the bench frame adjacent the other frame end. The vertical channels of the mounting structure holders permit horizontal adjustment of the vertical supports and thus of the footbar to any of a plurality of discrete fore-and-aft spaced, horizontal locations. These two adjustment capabilities of the adjustable footbar assembly allow a user to participate in activities involving pushing or pulling by his or her feet against the footbar. Also, the configuration of the mounting structure holders of the footbar assembly resists fore-and-aft movement of the footbar vertical supports at each of the discrete mounting locations.

The jump board attachment of the enhanced bench, the third feature of the present invention, is adapted for temporary attachment upon the vertical support members of the adjustable footbar assembly. The jump board includes a horizontal top flange adapted to overlie and rest upon the tops of the vertical support members of the footbar assembly, a vertical side panel attached to and extending downwardly from an edge of the top flange and adapted to rest against an inboard side of the vertical support members of the footbar assembly, and an elastic flexible member attached adjacent to opposite vertical edges of the side panel for stretching about the vertical support members of the footbar assembly for retaining the jump board attachment upon the footbar assembly. The side panel is positioned to receive impacts from the feet of a user's lying or seated on the mobile carriage and engaged in simulated jumping activities. The jump board attachment expands the range of activities that can be performed using the enhanced bench over that which could be carried out on the traditional prior art bench.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
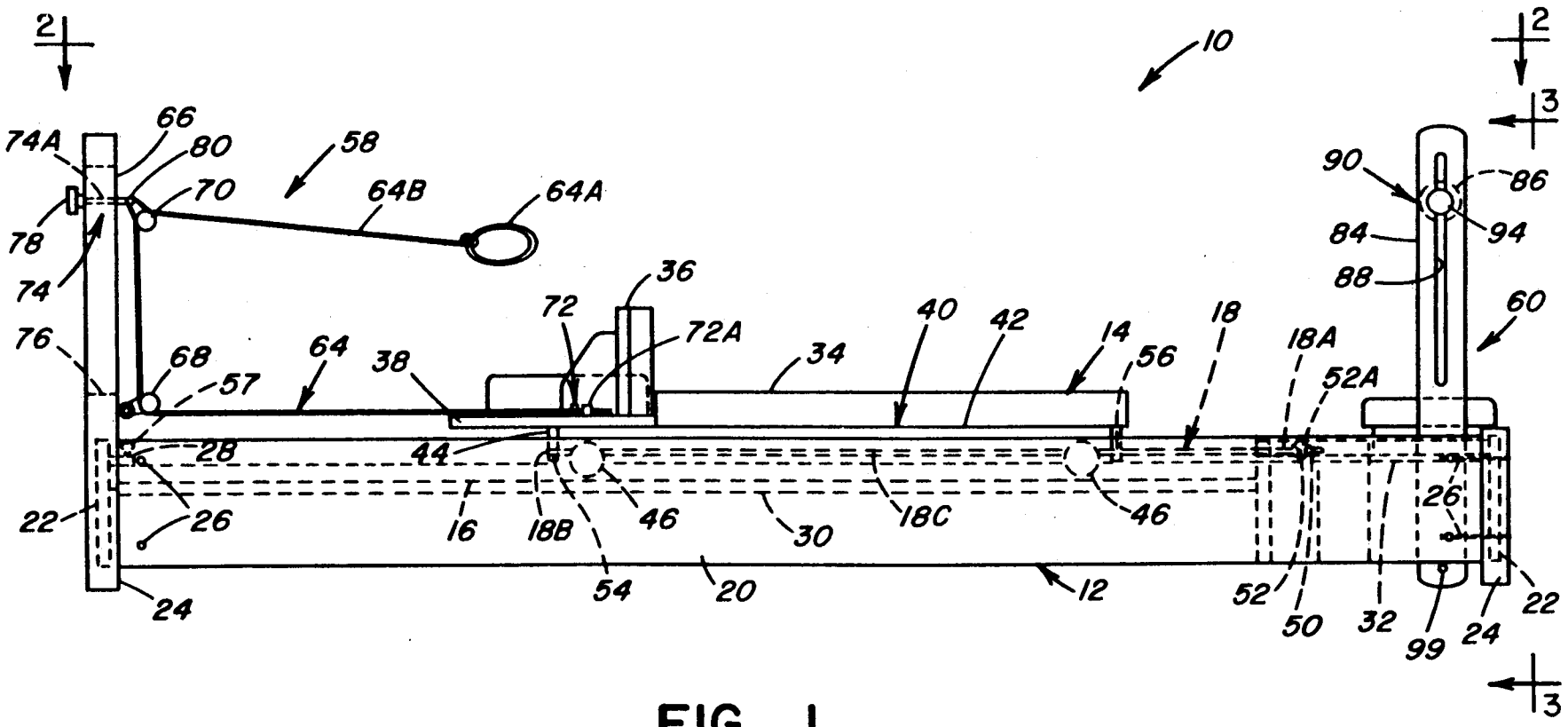
FIG. 1 is a side elevational view of an enhanced core movement training bench of the present invention.

In the following description, like reference characters designate like or corresponding parts throughout the several views of the drawings. Also in the following description, it is to be understood that such terms as "front", "rear", "upper", "lower", "left", "right", and the like, are words of convenience and are not to be construed as limiting terms.

In General

Figure 2:
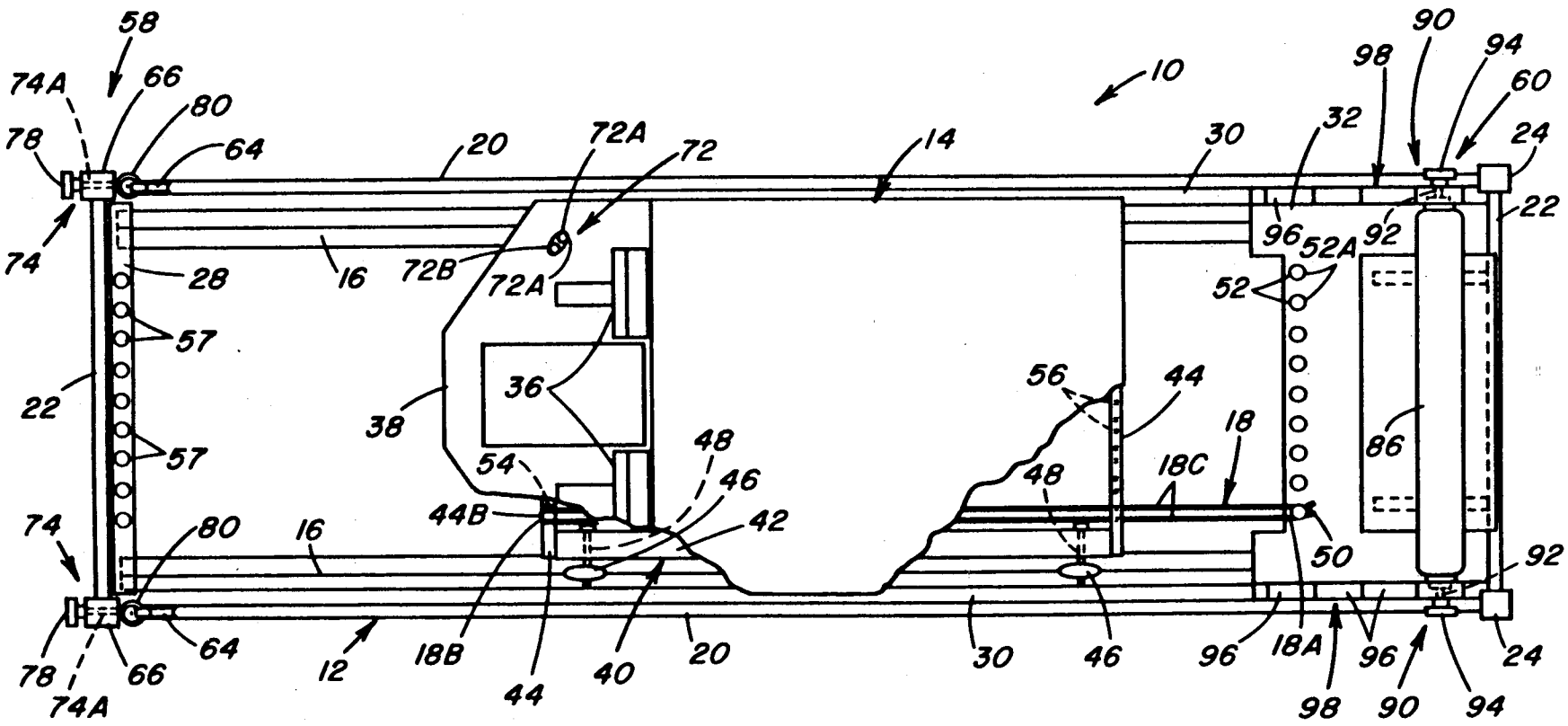
FIG. 2 is a top plan view of the enhanced bench as seen along line 2—2 of FIG. 1.
Figure 3:
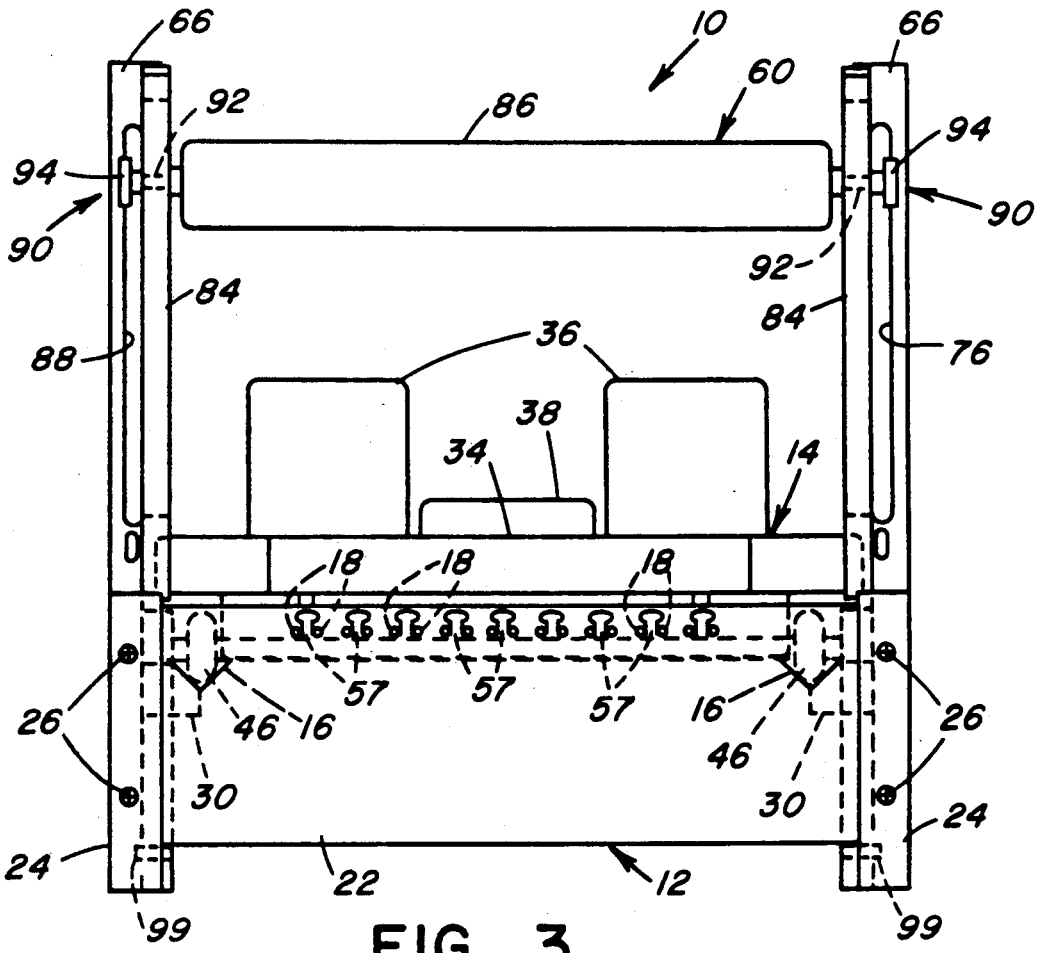
FIG. 3 is an end view of the enhanced bench as seen along line 3—3 of FIG. 1.
Figure 4:
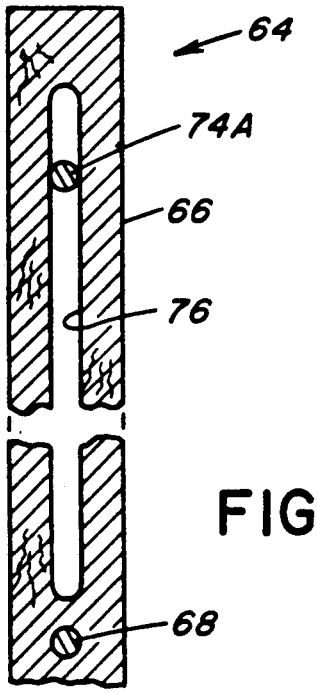
FIG. 4 is an enlarged vertical sectional view of one of a pair of extension posts of an adjustable arm cord mounting assembly of the enhanced bench of FIG. 1.

Referring to the drawings, and particularly to FIGS. 1-3, there is shown an enhanced core movement training bench, generally designated 10, incorporating the improved features of the present invention. The enhanced bench 10 can be used in an exercise program of core patterning for training the core muscle system. In its basic components, the enhanced bench 10 includes a generally rectangular peripheral frame 12, a mobile carriage 14, a pair of tracks 16 mounted on the frame 12 and supporting the carriage 14, and a set of elastic resistance tubes 18 interconnecting the carriage 14 and one end of the frame 12.

The peripheral frame 12 of the enhanced bench 10 is composed of a pair of side boards 20, a pair of end boards 22, and four corner posts 24. The side boards 20 are longer than the end boards 22, providing the frame with the generally rectangular configuration. Both side and end boards 20, 22 are oriented "on edge" such that the width dimension of each board is disposed in a vertical plane. The side and end boards 20, 22 are connected to the corner posts 24 by sets of detachable fasteners 26. Such fasteners 26 permit the frame 12 to be easily disassembled and taken apart for transport or storage.

The peripheral frame 12 also includes a narrow flange 28 attached to and projecting inwardly from an inboard side of the end board 20 at the "head" end (or left end as viewed in FIGS. 1 and 2) of the frame 12. Also, each side board 22 of the frame 12 has a rail 30 extending along and attached at a position on the inboard side of the respective side board 22 spaced below the upper edge thereof. Further, a mounting plate 32 extends between the side boards 22 and is attached on and supported by the rails 30 adjacent the inboard side of the "foot" end (or right end as viewed in FIGS. 1 and 2) of the frame 12.

As illustrated in FIGS. 1 and 2, the mobile carriage 14 of the enhanced bench 10 includes a flat padded platform 34 with vertical padded shoulder stops 36 and a padded head support extension 38 at the left end of the platform 34. The carriage 14 also includes an undercarriage frame 40 attached to the underside of the platform 34 and composed of a pair of side support beams 42 and a pair of end support beams 44 interconnecting the respective opposite fore-and-aft ends of the side support beams 42. The mobile carriage 14 further includes a pair of rollers 46 mounted by axles 48 to the undercarriage frame 40 adjacent the left and right ends of each of the side support beams 42 on the respective outboard sides thereof. The respective pairs of rollers 46 overlie the respective linear tracks 16 of the enhanced bench which are attached to the side rails 30 and extend along the inboard sides of the side boards 20 of the bench frame 12. The spaced tracks 16 of the enhanced bench 10 have V-shaped cross-sectional profiles for eliminating side play and reducing friction and thereby providing more smooth and accurate rolling motion of the rollers 46 without the usual wheel to side scuffing associated with the traditional prior art bench.

By way of example, the peripheral frame 12 and carriage platform 34 are preferably constructed of hard rock maple and 13-ply (¾") maple aircraft plywood. Though more expansive, aircraft plywood is used because of its superior dimensional stability, strength, stiffness, ding and scratch resistance, edge and surface appearance, and consistency. The padding on the platform 34 of the carriage 14 is fabricated of super-high-density foam. The tracks are made from structural grade aluminum. The rollers are the same as the Kryptonics Inline wheels used on the Rollerblade type roller-skates.

Each of the elastic resistance tubes 18 of the enhanced bench 10 is tied at its ends into a knot 50 to form a loop. Each tube 18 at its one loop end 18A having the knot 50 extends around one of a plurality of upstanding pegs 52 installed along the left edge of the mounting plate 32. Each tube 18 at its opposite loop end 18B extends around a portion 44A of the right end support beam 44 located between each of plurality of pairs of holes 54 in the beam 44. The parallel lengths 18C of the tube 18 extending between the opposite loop ends 18A, 18B extend through aligned pairs of holes 54, 56 in the respective right and left end support beams 44 of the undercarriage 40.

A second plurality of pegs 57 are mounted in upstanding relation along the flange 28 at the head end of the frame 12. The elastic resistance tubes 18 can be unhooked from the first plurality of pegs 52, the mobile carriage 14 lifted off the tracks 16, rotated 180° and then placed back on the tracks 16, and finally the tubes 18 rehooked around the second plurality of pegs 57. The provision of the pegs 57 and reversal of the carriage 14 permits expansion of the types of exercises a user can perform on the enhanced bench 10.

Typically, nine looped resistance tubes 18 are provided in the enhanced bench 10, with each tube 18 being of a different tension rating. One or more resistance tubes are hooked around corresponding pegs 52 at a given time. Each peg 52 has an enlarged head 52A to prevent the looped end 18A of the respective stretched tube 18 from slipping off the peg 52. It can be readily understood that the tubes 18 can be easily stretched to apply and remove them from the pegs 52. By way of example, the tubes 18 used are hollow Theraband elastic surgical tubes.

The improved features of the present invention incorporated by the enhanced core movement training bench 10 which will now be described in detail are an adjustable arm cord mounting assembly 58 shown in FIGS. 1–4, an adjustable footbar assembly 60 shown in FIGS. 1–3, 5 and 6, and a jump board attachment 62 shown in FIGS. 7 and 8.

Adjustable Arm Cord Mounting Assembly

Referring to FIGS. 1–4, the adjustable arm cord mounting assembly 58 includes a pair of elongated flexible non-elastic arm cords 64, a pair of vertical corner post extensions 66, and a pair of lower and upper guides 68, 70, an adjustable anchoring device 72 and an adjustable clamping device 74 associated with each arm cord 64 and corner post extension 66. The corner post extensions 66 extend above the frame 12 to an elevation above that of the carriage 14, and are generally aligned with opposite sides of the mobile carriage platform 34. The lower and upper guides 68, 70 preferably take the form of upper and lower pulleys 68, 70.

Each arm cord 64 is attached near one end to one of the anchoring devices 72. Each anchoring device 72 is a clamp composed of a pair of peripherally ribbed cam rollers 72A spaced from one another by a narrow gap 72B and mounted on the mobile carriage platform 34 adjacent to respective opposite sides of the platform 34. The rollers 72A can only counterrotate in the direction of the "foot" end of the bench frame 12 at the gap 72B between them so as to grip the cord 64 between the rollers 72A. The cord 64 can be removed from the rollers 72A by merely lifting it vertically from between the rollers 72A but not by pulling on it in the direction of the "head" end of the frame 12 at the gap 72B between the rollers.

Each arm cord 64 extends from the clamp 72 to the lower pulley 68 attached to one of the corner post vertical extensions 66 at a fixed height above the frame 12. The arm cord 64 extends around the lower pulley 68 and to and around the upper pulley 70 and then rearwardly to where an end loop 64A formed in the cord 64 is gripped by a user on the platform 34. Alternatively, it should be readily understood that each of the lower pulleys 68 can be stationarly attached to the frame 12 instead of the extensions 66.

The upper pulley 70 is mounted to the corner post vertical extension 66 by the adjustable clamp device 74 extending through a vertical slot 76 in the post extension 66. The adjustable clamp device 74 includes a stem 74A extending through the vertical slot 76 and having a knob 78 threaded on its outboard end and an attaching ring 80 fixed on its inboard end. The upper pulley 70 is coupled to the ring 80. The knob 78 can be threadably loosened and then tightened relative to the post extension 66 in order to relocate the upper pulley 66 along the vertical slot 76 and then secure it at a desired height above the frame 12.

The vertical mounting slots 76 in the corner post extensions 66 thus permit infinite adjustment of the vertical positions above the bench frame 12 of the upper pulleys 70 and of the upper portions 64B of the arms cords 64 extending from the corner post extensions 66 to the user on the platform 34. Similarly, the anchoring devices 72 permit infinite adjustment of the effective lengths of the arm cords 64. These adjustment capabilities of the adjustable arm cord assembly 58 enable a user to quickly and easily select a suitable position on the platform 34 of the mobile carriage 14 and to tailor the enhanced bench 10 to accommodate a range of motions corresponding to the user's particular body size and arm reach.

By way of example, the arm cords 64 can be Samson yacht braid cords. The pulleys 68, 70 and anchoring devices 72 can be Harken pulleys and camlocks.

Adjustable Footbar Assembly

Figure 5:
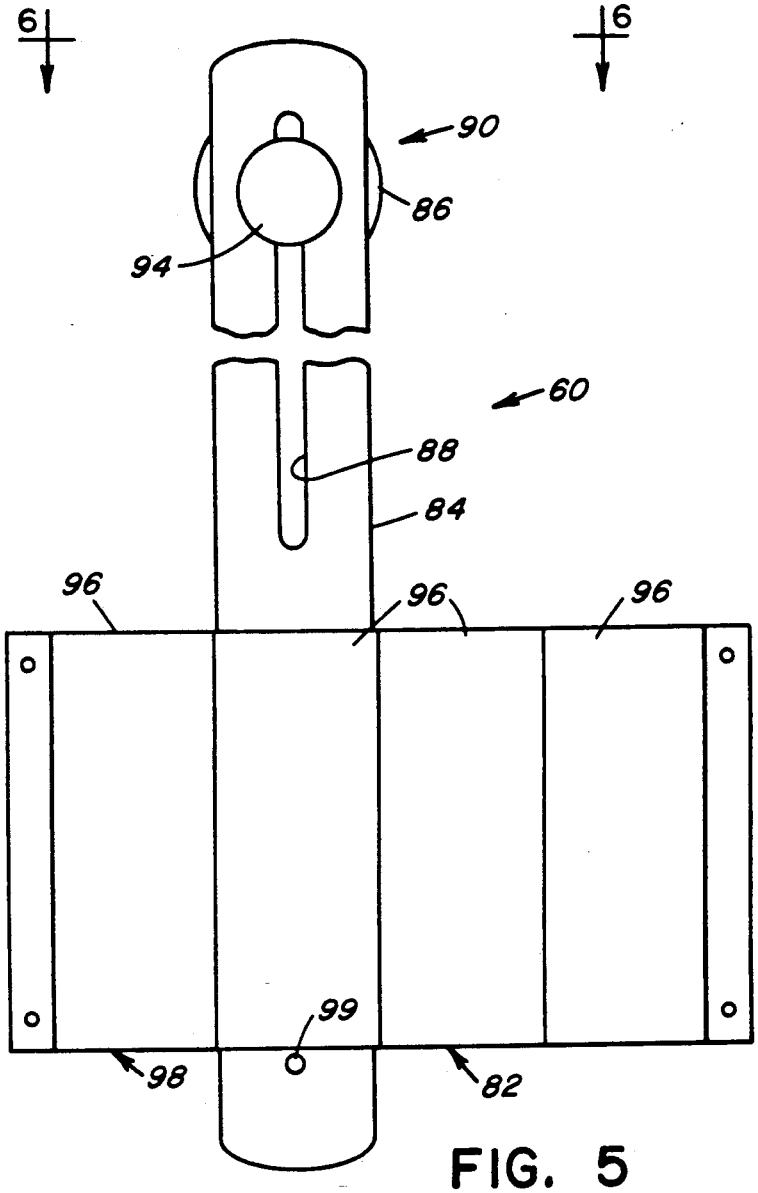
FIG. 5 is an enlarged foreshortened side elevational view of an adjustable footbar assembly of the enhanced bench of FIG. 1.
Figure 6:
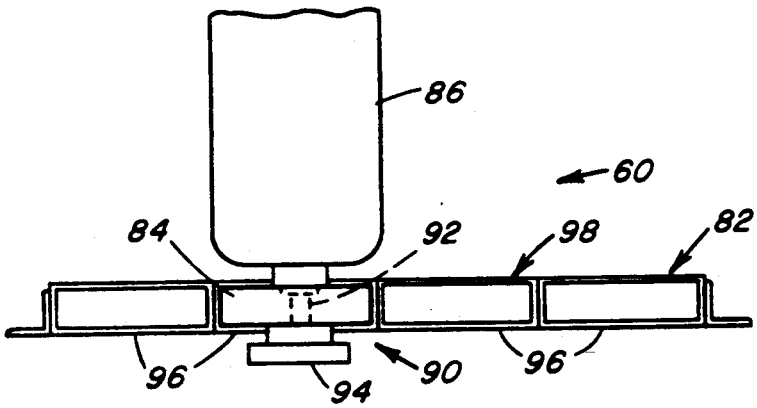
FIG. 6 is a top plan view of the footbar assembly as seen along line 6—6 of FIG. 5.

Referring to FIGS. 5 and 6, the adjustable footbar assembly 60 includes a mounting structure 82, a pair of vertical support members 84 supported upright by the mounting structure 82, and a padded horizontal cylindrical footbar 86 extending between and slidably mounted at its opposite ends within respective vertical slots 88 defined in the vertical support members 84. The footbar 86 has an adjustment mechanism 90 mounted at each of its respective opposite ends.

Each adjustment mechanism 90 includes a threaded stub shaft 92 fixed to and projecting axially from the footbar end through one of the slots 88, and a knob 94 rotatably and threadably mounted on the stub shaft 92. Each knob 94 can be threadably loosened and then tightened relative to the support member 84 in order to relocate the footbar 86 along the vertical slots 88 and then secure it at a desired height above the frame 12. The vertical slots 88 and adjustment mechanisms 90 permit infinite adjustment of the vertical position of the footbar 86 above the enhanced bench frame 12.

The vertical support members 84 are installed upright in a selected one pair of vertical hollow channels 96 provided by the mounting structure 82 of the adjustable footbar assembly 60. The mounting structure 82 is in the form of a pair of holders 98 each containing a plurality of the vertical channels 96 arranged in tandem relation to one another in a fore-and-aft extending row. Each holder 98 is attached to the inboard side of one of the side board 20 adjacent the foot end of the bench frame 12. The vertical channels 96 of the holders 98 of the mounting structure 82 permit horizontal relocation or adjustment of the vertical support members 84 and thus of the footbar 86 to any of a plurality of discrete fore-and-aft spaced, horizontal locations. A pin 99 is inserted through the lower end portion of each support member 84 which extends below the holders 98 in order to prevent inadvertent withdrawal of the support members 84 upwardly from the holders 98.

The above-described vertical and horizontal adjustment capabilities of the adjustable footbar assembly 60 allow a user to participate in activities involving pushing or pulling by his or her feet against the footbar 86. Also, the configuration of the mounting structure 82 of the footbar assembly 60 resists fore-and-aft movement of the footbar vertical support members 84 at each of the discrete mounting locations. By way of example, the footbar 86 is adjustable horizontally twelve inches fore-and-aft in three inch increments, and has an infinite range of vertical positions from two to sixteen inches above the carriage 14 to properly accommodate the various femur and tibia lengths of any size person.

Jump Board Attachment

Figure 8:
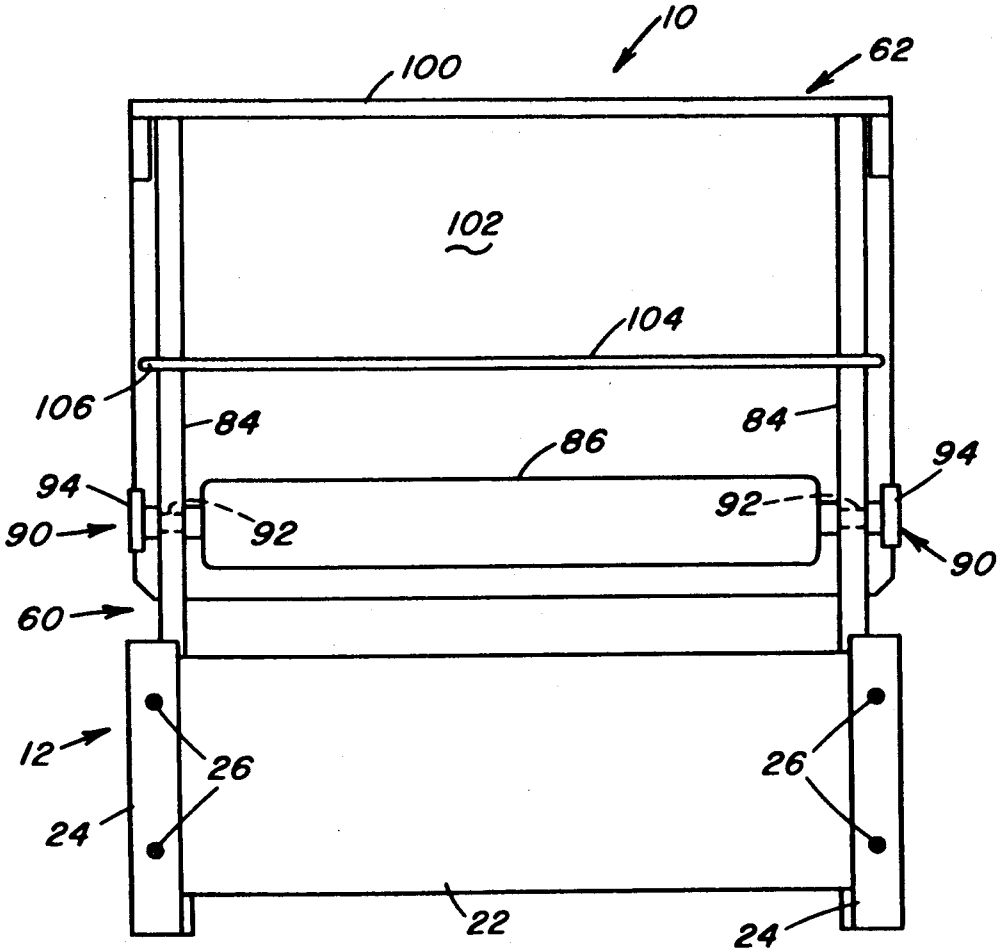
FIG. 8 is an end elevational view of the jump board attachment as seen along line 8—8 of FIG. 7.
Figure 7:
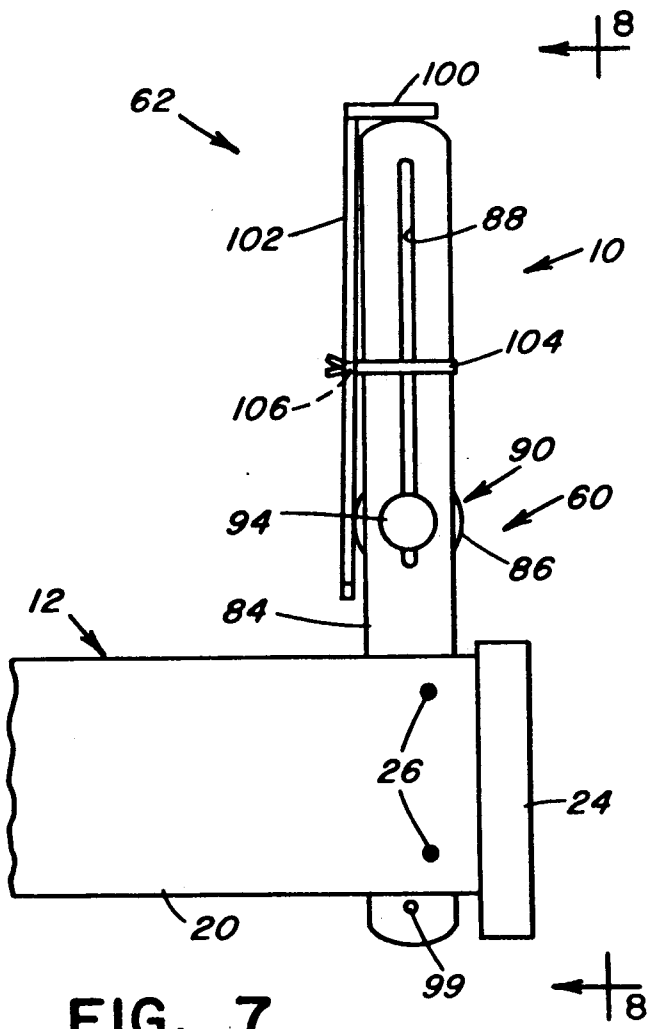
FIG. 7 is an enlarged side elevational view of a jump board attachment mounted on the footbar assembly of the enhanced bench of FIG. 1.

Referring to FIGS. 7 and 8, the jump board attachment 62 mounts on the adjustable footbar assembly 60 of the enhanced bench 10. The jump board attachment 62 is adapted for temporary attachment upon the vertical support members 84 of the adjustable footbar assembly 60. The jump board attachment 62 includes a horizontal top flange 100, a vertical side panel 102, and retaining means 104. The top flange 100 is adapted to overlie and rest upon the tops of the vertical support members 84 of the footbar assembly 60. The vertical side panel 102 is attached to and extends downwardly from an edge of the top flange 100 and is adapted to rest against an inboard side of the vertical support members 84 of the footbar assembly 60. The retaining means 104 is a stretchible flexible member, such as an elastic cord, attached to the side panel 102 by holes 106 formed in the side panel 102 adjacent to the opposite vertical edges thereof. The flexible member 104 can be stretched about the vertical support members 84 of the adjustable footbar assembly 60 for temporarily retaining the jump board attachment 62 upon the footbar assembly 60.

The side panel 102 of the jump board attachment 62 is positioned to receive impacts from the feet of a user lying on the mobile carriage 14 and engaged in simulated jumping activities. The jump board attachment 62 thus expands the range of activities that can be performed using the enhanced bench 10 over that which could be carried out on the traditional prior art bench.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. In a core movement training bench including a peripheral frame with opposite ends, a mobile carriage, a pair of tracks mounted on said frame and supporting said carriage for fore-and-aft reciprocal movement between said opposite ends of said frame, and a plurality of elastic resistance elements interconnecting said carriage and one of said ends of said frame, an adjustable arm cord mounting assembly comprising:

(a) a pair of elongated flexible arm cords each having opposite ends;

(b) a pair of anchoring devices disposed on said carriage each for anchoring one of said respective arm cords to said carriage:

(c) a pair of extensions mounted at the other of said ends of said frame, extending generally upwardly from said frame to a desired height above said frame and carriage, and being aligned with opposite sides of said carriage;

(d) a pair of lower guides mounted on either of said other end of said frame or said respective extensions;

(e) a pair of upper guides mounted on said respective extensions in generally vertical spaced relation above said lower guides; and (f) means for adjustably mounting said upper guide to said respective one extension for vertical movement toward and away from said lower guide to vary the height of said upper guide above said frame and carriage, each said arm cord extending generally horizontally from said anchoring device on said carriage to and around one said lower guide, generally vertically from said one lower guide to and around said corresponding one upper guide, and generally horizontally from said one upper guide toward said carriage to one of said ends of said arm cord for gripping by a user on said carriage.

2. The arm cord mounting assembly of claim 1 wherein said one of said ends of said arm cord has a loop formed therein for gripping by a user on said carriage.

3. The arm cord mounting assembly of claim 1 wherein each said extension has a generally vertical slot defined therein.

4. The arm cord mounting assembly of claim 3 wherein said mounting means includes an adjustable clamp device extending through said vertical slot in said extension for adjustably mounting said upper guide to said extension.

5. The arm cord mounting assembly of claim 4 wherein said adjustable clamp device includes:

an elongated stem extending through said vertical slot;

an attaching element fixed on an inboard end of said stem, said upper guide being coupled to said element; and a knob threaded on an outboard end of said stem and capable of being threadably loosened and then re-tightened relative to said extension after said upper guide has been relocated along said vertical slot in order to secure said upper guide at a desired height above said frame and carriage, said vertical slot and said adjustable clamp device thereby permitting infinite adjustment of the height of said upper guide above said frame and thereby of a portion of said arm cord extending from said upper guide to a user on said carriage in order to accommodate a range of motions corresponding to a user's particular body size and arm reach.

6. The arm cord mounting assembly of claim 1 wherein each said anchoring device is operable for anchoring one of said respective arm cords to said carriage at a portion thereof nearer to other of said opposite ends of said cord than to said one of said opposite ends of said cord.

7. The arm cord mounting assembly of claim 6 wherein each said anchoring device is a clamp mounted on said carriage adjacent to respective opposite sides thereof for securing one of said respective arm cords to said carriage.

8. The arm cord mounting assembly of claim 7 wherein each said clamp is composed of a pair of peripherally ribbed cam rollers spaced from one another by a gap and being operable for engaging said portion of said respective arm cord extending through said gap to grip and secure said arm cord at said portion thereof to said carriage.

9. The arm cord mounting assembly of claim 1 wherein each said anchoring device is operable for gripping and releasing said respective arm cord so as to permit infinite adjustment of the effective length of said arm cord between said carriage and a user on said carriage.

10. In a core movement training bench including a peripheral frame with opposite ends, a mobile carriage, a pair of tracks mounted on said frame and supporting said carriage for fore-and-aft reciprocal movement between said opposite ends of said frame, and a plurality of elastic resistance elements interconnecting said carriage and one of said ends of said frame, an adjustable footbar assembly comprising:

a mounting structure supported at said one end of said frame;

a pair of support members supported upright by said mounting structure adjacent opposite sides and said one end of said frame so as to extend to a desired height above said frame and said carriage;

a footbar extending generally horizontally between and slidably mounted at its opposite ends to said upright support members; and means attached to said footbar and being operable for adjustably changing the height of said footbar above said frame and carriage.

11. The footbar assembly of claim 10 wherein said upright support members each has an elongated slot therein, said opposite ends of said footbar being slidably mounted within said respective vertical slots of said support members.

12. The footbar assembly of claim 10 wherein said means for adjustably changing the height of said footbar is a pair of adjustment mechanisms each mounted at one of said opposite ends of said footbar.

13. The footbar assembly of claim 12 wherein said upright support members each has an elongated slot therein, said opposite ends of said footbar being slidably mounted within said respective vertical slots of said support members.

14. The footbar assembly of claim 13 wherein each said adjustment mechanism includes:

a threaded stub shaft fixed to and projecting axially from said end of said footbar end through one of said vertical slots of said respective one support member; and a knob rotatably and threadably mounted on said stub shaft in order that said knob can be threadably loosened and then re-tightened relative to said support member in order to relocate the footbar along said each vertical slot and then secure it at a desired height above said frame and carriage such that said vertical slot and adjustment mechanisms permit infinite adjustment of the height of said footbar above said frame and carriage.

15. The footbar assembly of claim 10 wherein said mounting structure includes a pair of holders located adjacent opposite sides and said one end of said frame and each containing a plurality of vertical hollow channels arranged in tandem relation to one another in a row extending fore-and-aft relative to said opposite ends of said frame, said support members being removably installed upright in a selected one pair of said vertical hollow channels of said holders, said vertical channels permitting relocation of said support members and thereby said footbar to any of a plurality of discrete fore-and-aft spaced horizontal locations of said channels.

16. In a core movement raining bench including a peripheral frame with opposite ends, a mobile carriage, a pair of tracks mounted on said frame and supporting said carriage for fore-and-aft reciprocal movement between said opposite ends of said frame, and a plurality of elastic resistance elements interconnecting said carriage and one of said ends of said frame, the combination comprising:

an adjustable arm cord mounting assembly disposed at the other of said ends of said frame and interconnected to said carriage; and an adjustable footbar assembly mounted upright at said one of said ends of said frame, said adjustable footbar assembly including a mounting structure supported at said one end of said frame, a pair of support members supported upright by said mounting structure adjacent opposite sides and said one end of said frame so as to extend to a desired height above said frame and carriage, a footbar extending generally horizontally between and slidably mounted at its opposite ends to said upright support members, and means attached to said footbar and being operable for adjustably changing the height of said footbar above said frame and carriage.

17. The combination of claim 16 wherein said arm cord mounting assembly includes:

a pair of elongated flexible arm cords each having opposite ends;

a pair of anchoring devices disposed on said carriage each for anchoring one of said respective arm cords to said carriage;

a pair of extensions mounted at the other of said ends of said frame, extending generally upwardly from said frame to a desired height above said frame and carriage, and being aligned with opposite sides of said carriage;

a pair of lower guides mounted on either of said other end of said frame or said respective extensions;

a pair of upper guides mounted on said respective extensions in generally vertical spaced relation above said lower guides; and means for adjustably mounting said upper guide to said respective one extension for vertical movement toward and away from said lower guide to vary the height of said upper guide above said frame and carriage, each said arm cord extending generally horizontally from said anchoring device on said carriage to and around said lower guide, generally vertically from said lower guide to and around said upper guide, and generally horizontally from said upper guide toward said carriage to one of said ends of said arm cord for gripping by a user on said carriage.

18. In a core movement training bench including a peripheral frame with opposite ends, a mobile carriage, a pair of tracks mounted on said frame and supporting said carriage for fore-and-aft reciprocal movement between said opposite ends of said frame, and a plurality of elastic resistance elements interconnecting said carriage and one of said ends of said frame, the combination comprising:

a footbar assembly mounted upright at said one end of said frame, said footbar assembly having a pair of upright support members; and a jump board attachment removably mounted on said upright support members of said footbar assembly, said jump board attachment including a generally horizontal top flange adapted to overlie and rest upon tops of said upright support members, a generally vertical side panel attached to and extending downwardly from said top flange and being adapted to rest against a side of said upright support members facing away from said one end of said frame and toward said carriage, and means connected to said side panel for retaining said jump board attachment on said footbar assembly.

19. The combination of claim 18 wherein said retaining means is a stretchible flexible member attached to said side panel adjacent to opposite vertical edges thereof such that said flexible member can be stretched about said upright support members of said footbar assembly for temporarily retaining said jump board attachment upon said footbar assembly.

* * * * *